United States Patent [19]

Numata et al.

[11] Patent Number: 4,924,742

[45] Date of Patent: May 15, 1990

[54] MECHANICAL KEYBOARD INSTRUMENT WITH PEDAL MECHANISMS

[75] Inventors: Motoichi Numata; Kinya Nozaki; Hajime Hayashida; Toshiaki Sakai, all of Shizuoka, Japan

[73] Assignee: Yamaha Corporation, Hamamatsu, Japan

[21] Appl. No.: 362,502

[22] Filed: Jun. 6, 1989

[30] Foreign Application Priority Data

| | | | |
|---|---|---|---|
| Jun. 7, 1988 | [JP] | Japan | 63-141273 |
| Aug. 11, 1988 | [JP] | Japan | 63-200349 |
| Sep. 27, 1988 | [JP] | Japan | 63-126045[U] |
| Oct. 4, 1988 | [JP] | Japan | 63-250632 |

[51] Int. Cl.[5] ..... G10C 3/00

[52] U.S. Cl. ..... 84/218; 84/245

[58] Field of Search ..... 84/216, 218, 243, 244, 84/245

[56] References Cited

U.S. PATENT DOCUMENTS 1,822,214 9/1931 Hammond, Jr. ..... 84/218

*Primary Examiner*—L. T. Hix
*Assistant Examiner*—Brian W. Brown
*Attorney, Agent, or Firm*—Burns, Doane, Swecker & Mathis

[57] ABSTRACT

A mechanical keyboard according to the present invention has a main sostenuto pedal mechanism for holding off a damper associated with a key depressed and an auxiliary sostenuto pedal mechanism provided for keys of a bass range for holding off the associated damper or dampers, and the auxiliary pedal is provided in the vicinity of a soft pedal for easy depression.

12 Claims, 17 Drawing Sheets

MECHANICAL KEYBOARD INSTRUMENT WITH PEDAL MECHANISMS

FIELD OF THE INVENTION

This invention relates to a mechanical keyboard instrument and more particularly, to a sostenuto pedal mechanism incorporated in a mechanical piano.

BACKGROUND OF THE INVENTION

The mechanical piano is usually associated with triple pedal mechanisms. One of the pedal mechanisms is called as a loud pedal mechanism which makes the sound prolonged (or loud) by holding off all the dampers provided for music wires. The loud pedal mechanism is sometimes called "damper pedal mechanism".

The second pedal mechanism is called as a soft pedal mechanism which varies the sound in quality (or in volume) by causing fewer than the normal number of strings to be struck or by bringing the hammers nearer the strings. The soft pedal mechanism is sometimes called as "shift pedal mechanism", especially in the case of the grand piano.

The third pedal mechanism is known as a sostenuto pedal mechanism, and the sostenuto pedal mechanism is used for prolonging the sound by holding off the associated damper independently from the others. When the player depresses a key, the key action mechanism associated with the depressed key causes the damper to leave from the music wire, and, then, the hammer strikes the music wire to produce a sound assigned to the depressed key. If the player operates the sostenuto pedal by the foot and, then, releases the key, the damper keeps off to prolong the sound for a while. The sostenuto pedal mechanism thus arranged is convenient for the variety of a musical expression. Namely, whenever the player needs to depress another key by the same finger without any rapid attenuation of the previous sound, the player operates the sostenuto pedal for prolonging the sound and moves his finger onto another key for depression.

In a typical mechanical piano, the triple pedals are provided under the keyboard so as to be operated by the feet of the player, and the sostenuto pedal is located between the other two pedals. The present invention appertains to the sostenuto pedal mechanism, and, for this reason, description is hereinbelow made for the prior art sostenuto pedal mechanism for better understanding of the Applicant's invention.

An essential part of the prior art mechanical piano is illustrated in FIG. 1 and largely comprises a key 1 provided on a key bed 3 and linked with a key action mechanism (not shown), a damper mechanism 5 engageable with the rear end portion of the key 1 and coupled to a damper 7, and a sostenuto mechanism 9 coupled to the damper mechanism 5. The damper mechanism 5 has a damper lever 11 connected at one end thereof to a damper lever flange 13 which in turn connected to a damper lever rail (not shown). The other end portion of the damper lever 11 is slightly spaced apart from the rear end portion of the key 1 under the releasing of the key 1, however, brought into engagement therewith upon a depression of the key 1. The damper mechanism 5 further has a damper block 17 angularly rotatable around a pin member 19, and a damper lever 21 interconnecting the damper block 17 and the damper 7. The damper 7 is usually in contact with a music wire 23 for restriction on a free vibration produced in the music wire 23, however, momentarily leaves from the music wire 23 upon the depression of the key 1.

The damper block 17 is provided with a tab lip 25 turnable with respect to the damper block 17, and the tab lip 25 is forced by a spring 27 in the counter-clockwise direction. With the resilient force, the tab lip 25 usually comes into abutting engagement with a tab flange felt 29. The tab lip 25 has a projection 31 covered with a tab lip cloth 33 and confronts to a blade member 35 attached to a sostenuto rod 37. The sostenuto rod 37 is rotatable around the center axis thereof and engaged with a sostenuto pedal 39 through a pedal rod 41. When the sostenuto pedal 39 is depressed by the player, the sostenuto rod 37 is driven for rotation in the clockwise direction over a certain angle, and, accordingly, the blade member 35 is brought into abutting engagement with the projection 31, thereby lifting the damper block 17 and, accordingly, the damper 7 to leave from the music wire 23. The blade member 35, the sostenuto rod 37, the pedal rod and the sostenuto pedal 39 as a whole constitute an essential part of the sostenuto mechanism 9. The blade member 35 and, accordingly, the sostenuto rod 37 are shared by all of the keys associated with the damper mechanisms, and provided on the front or the player's side with respect to the damper mechanisms.

When the player depresses the key 1 without any operation on the sostenuto pedal 39, the rear end portion of the key 1 is brought into abutting engagement with the damper lever 11 and causes the damper lever 11 to rotate in the counter-clockwise direction with respect to the damper lever flange 13. With the lifting motion, the damper 7 leaves from the music wire 23, and the music wire 23 produces a sound due to a striking motion of a hammer driven by the key action mechanism. However, if the key 1 is released, the damper mechanism 5 is allowed to pull down the damper 7 toward the music wire 23, so that any free vibration is restricted by the damper 7.

If, on the other hand, the sostenuto pedal 39 is depressed by the player's foot in the depression of the key 1, the sostenuto rod 37 is driven for rotation in the clockwise direction, and the blade member 35 causes the tab lip 25 to rotate in the counter-clockwise direction, so that the damper block 17 and, accordingly, the damper rod 21 are lifted up so as to allow the damper 7 to leave from the music wire 23. The blade member 35 keeps the position in so far as the sostenuto pedal 39 is depressed, and, for this reason, the damper 7 does not return to the engaging position with the music wire 23 even though the key 1 is released. This results in that the music wire continues to vibrate, thereby prolonging the sound produced.

If the key is depressed after the operation on the sostenuto pedal 39, the tab lip 25 is brought into abutting engagement with the lower surface of the blade member 35, however, no influence takes place in the lifting motion. When the player releases the key 1, the damper lever 11 returns to the original position without any restriction by the sostenuto mechanism 9.

The sostenuto pedal mechanism thus arranged allows the music wire to prolong the sound produced therein and is desirable for the expansion of the musical expression. For example, sustained bass sounds are preferable for a gentle piano music such as the Chopin's cradle song, and such a sustained bass sound is achieved by using the sostenuto pedal mechanism.

However, a problem is encountered in the prior art sostenuto pedal mechanism in operability. In detail, the loud pedal is usually operated by the right foot of the player, however, not only the soft pedal but also the sostenuto pedal are depressed by the left foot of the player. Whenever the player operates wants to sustain an extremely soft sound by using the soft pedal mechanism, his left foot needs to simultaneously depress the sostenuto pedal. This requests the player to turn his left foot over the right angles around the heel. However, this attitude is unnatural for the human being.

SUMMARY OF THE INVENTION

It is therefore an important object of the present invention to improve the operability of the mechanical piano.

It is also an important object of the present invention to provide a mechanical piano which has a sostenuto pedal mechanism easily operable in the simultaneous depression.

To accomplish these objects, the present invention proposes to provide an auxiliary sostenuto pedal mechanism provided for a part of the keyboard.

In accordance with one aspect of the present invention, there is provided a mechanical keyboard for producing sounds, comprising: (a) a key board having a plurality of keys grouped by note ranges, the keys being shifted between depressed states and released states, respectively; (b) a plurality of key action mechanisms respectively coupled to the keys and respectively transferring forces produced by depressing the keys; (c) a plurality of music wires respectively provided in association with the keys; (d) a plurality of hammers respectively actuated by the key action mechanisms for striking the music wires; (e) a plurality of damper mechanisms respectively having dampers and respectively shifted between contact states contacting the music wires and hold off states leaving from the music wires, the dampers being shifted to the contact states in the released states and to the hold off states in the depressed states, respectively, the dampers being associated with the keys, respectively; (f) a loud pedal mechanism having a loud pedal and operative to cause all of the dampers to shift into the hold off states even if the keys are in the released states; (g) a soft pedal mechanism having a soft pedal and operative to cause the sounds to be varied in quality or decreased in volume; (h) a main sostenuto pedal mechanism having a main sostenuto pedal located between the loud pedal and the soft pedal and operative to cause one of or a plurality of the dampers to keep in the hold off states after the associated keys are depressed; and (i) an auxiliary sostenuto pedal mechanism having an auxiliary sostenuto pedal and provided for the dampers associated with the keys of at least one of the note ranges, wherein the auxiliary sostenuto pedal mechanism is operative to allow one or a plurality of the dampers to keep in the hold off states even if the associated keys are released.

In accordance with another aspect of the present invention, there is provided a mechanical keyboard for producing musical sounds, comprising: (a) a key board having a plurality of keys grouped by note ranges, the keys being shifted between depressed states and released states, respectively; (b) a plurality of key action mechanisms respectively coupled to the keys and respectively transferring forces produced by depressing the keys; (c) a plurality of music wires respectively provided in association with the keys; (d) a plurality of hammers respectively actuated by the key action mechanisms for striking the music wires; (e) a plurality of damper mechanisms respectively having dampers and respectively shifted between contact states contacting the music wires and hold off states leaving from the music wires, the dampers being shifted to the contact states in the released states and to the hold off states in the depressed states, respectively, the dampers being associated with the keys, respectively; (f) a loud pedal mechanism having a loud pedal and operative to cause all of the dampers to shift into the hold off states even if the keys are in the released states; (g) a soft pedal mechanism having a soft pedal and operative to cause the sounds to be varied in quality or decreased in volume; (h) a main sostenuto mechanism provided for the dampers associated with the keys and operative to cause one of or a plurality of the dampers to keep in the hold off states after the associated keys are depressed; (i) an auxiliary sostenuto mechanism provided for the dampers associated with the keys of one of the note ranges and operative to cause one of or a plurality of the dampers to keep in the hold off states after the associated keys are depressed; (j) a sostenuto pedal shared by the main and auxiliary sostenuto mechanisms; (k) a steering mechanism coupled at one end thereof to the sostenuto pedal and at the other end thereof to the main and auxiliary sostenuto pedal mechanisms; and (l) a change-over switch coupled to the steering mechanism and operative to cause the steering mechanism to couple the sostenuto pedal to either main or auxiliary sostenuto pedal mechanism.

BRIEF DESCRIPTION OF THE DRAWINGS

The features and advantages of a mechanical keyboard according to the present invention will be more clearly understood from the following description taken in conjunction with the accompanying drawings in which.

DESCRIPTION OF THE PREFERRED EMBODIMENTS

First embodiment

Figure 1:
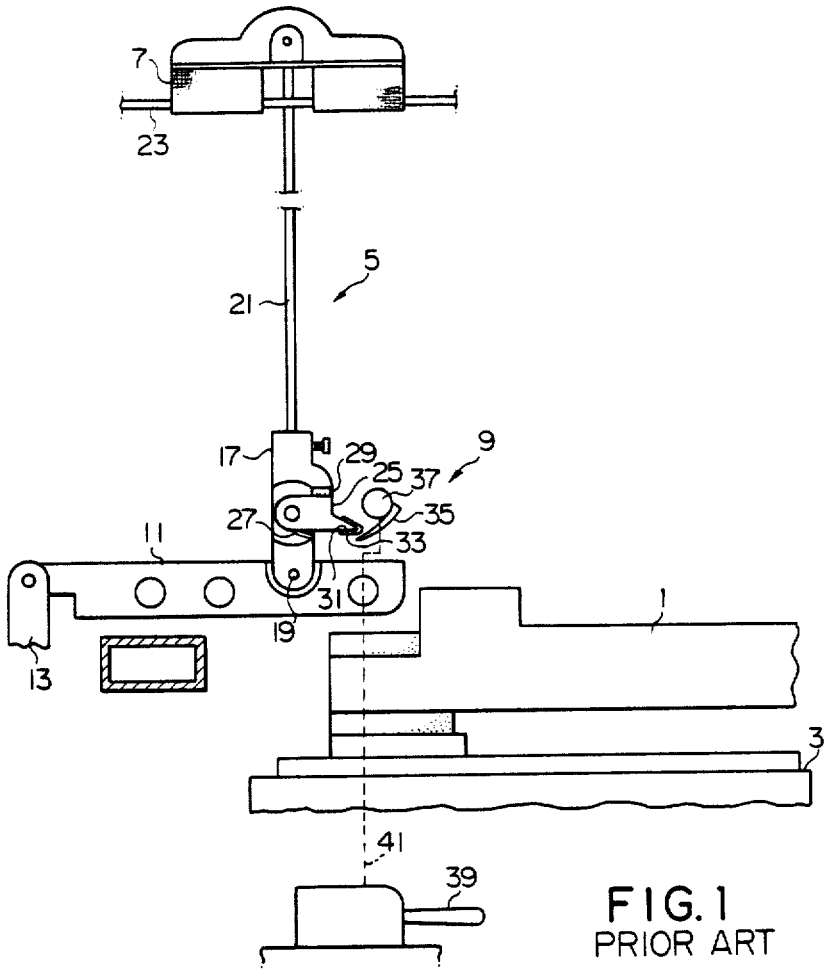
FIG. 1 PRIOR ART
FIG. 1 is a side view showing an essential part of the prior art mechanical piano.
Figure 2:
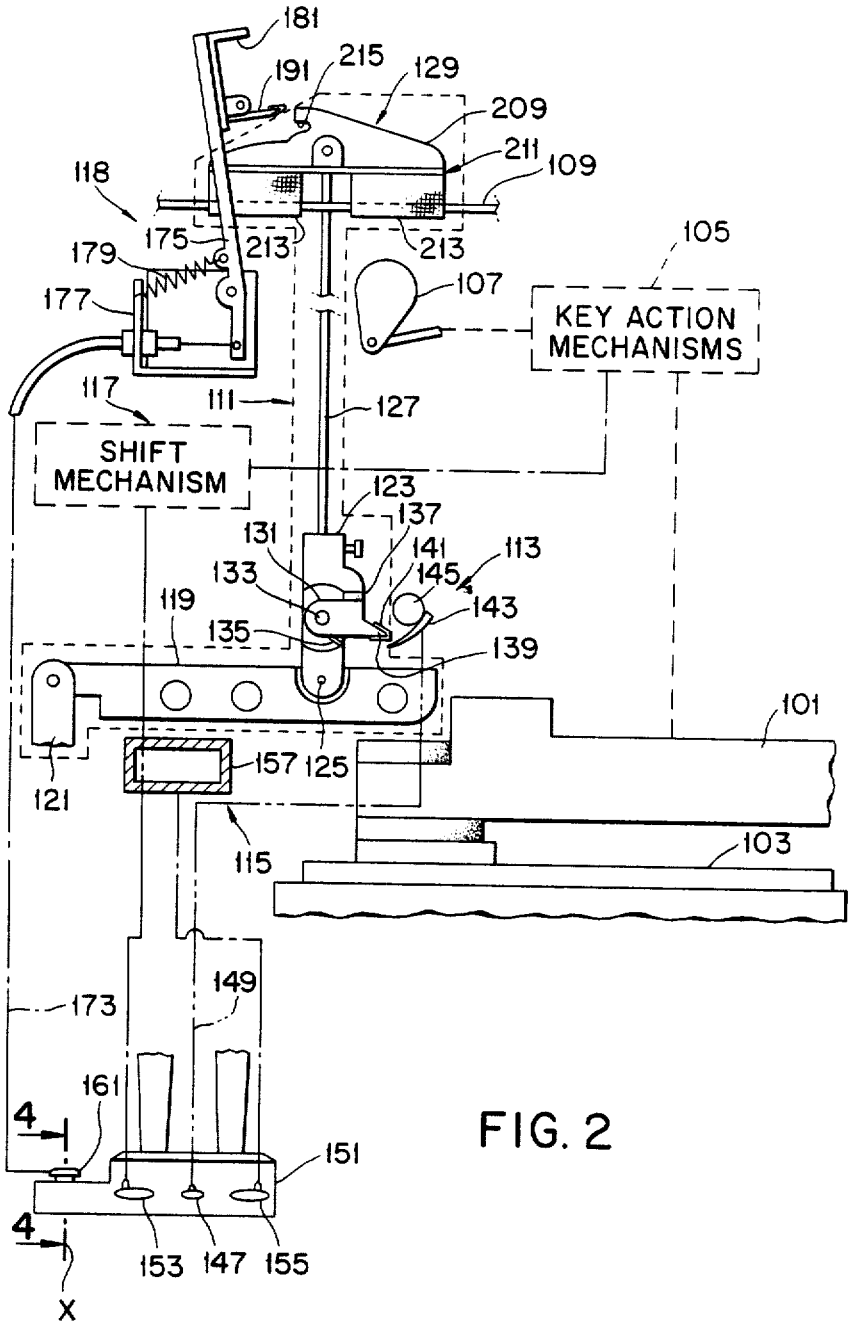
FIG. 2 is a view showing an essential part of a mechanical piano embodying the present invention.

Referring first to FIG. 2 of the drawings, a mechanical piano according to the present invention largely comprises a keyboard 101 provided with a plurality of, typically 88 keys provided on a key bed 103, a plurality of key action mechanisms 105 respectively coupled to the keys for transferring respective key motions to associated hammers 107, a plurality of music wires 109 struck by the associated hammers 107, a plurality of damper mechanisms 111 engageable with the associated keys, respectively, a main sostenuto pedal mechanism 113 shared by all of the keys associated with the damper mechanisms 111, a loud pedal mechanism 115 also shared by the keys, a soft pedal mechanism 117, and an auxiliary sostenuto pedal mechanism 118. Although each of the music wires of the bass part are formed by a single thick music string, the music strings are doubled or tripled for each of the other parts. Even though, these doubled or tripled music strings are hereinbelow referred to as "a music wire". The key action mechanisms 105 , the hammers 107, the music wires 109 and the damper mechanisms 111 are thus provided in association with the keys, respectively, however, description will be focused upon a single set of the mechanisms associated with one of the keys which are designated by the same reference numerals assigned to those component groups.

The damper mechanism 111 has a damper lever 119 connected at one end thereof to a damper lever flange 121 which in turn connected to a damper lever rail (not shown). The other end portion of the damper lever 119 is slightly spaced apart from the rear end portion of the key 101 under the releasing of the key 101, however, brought into engagement therewith upon a depression of the key 101. The damper mechanism 111 further has a damper block 123 angularly rotatable around a pin member 125, and a damper wire 127 interconnecting the damper block 123 and a damper 129. The damper 129 is usually in contact with the music wire 109 for restriction on a free vibration produced in the music wire 109, however, momentarily leaves from the music wire 109 upon the depression of the key 101.

The damper block 123 is provided with a tab lip 131 turnable around a pin 133 with respect to the damper block 123, and the tab lip 131 is forced by a spring 135 in the counter-clockwise direction. With the resilient force, the tab lip 131 usually comes into abutting engagement with a tab flange felt 137. The tab lip 131 has a projection 139 covered with a tab lip cloth 141 and confronts to a blade member 143 attached to a sostenuto rod 145. The sostenuto rod 145 is rotatable around the center axis thereof and engaged with a sostenuto pedal 147 through a pedal rod 149. The sostenuto pedal 147 is swingablly supported by a lyre block 151 which further supports a soft pedal 153 and a loud pedal 155. When the sostenuto pedal 147 is depressed by the player, the sostenuto rod 145 is driven for rotation in the clockwise direction over a certain angle, and, accordingly, the blade member 143 is brought into abutting engagement with the projection 139, thereby lifting the damper block 123 and, accordingly, the damper 129 to leave from the music wire 109. The blade member 143, the sostenuto rod 145, the pedal rod 149 and the sostenuto pedal 147 as a whole constitute the main sostenuto pedal mechanism 113. The blade member 143 and, accordingly, the sostenuto rod 145 are shared by all of the keys associated with the damper mechanisms, and provided on the front or the player's side with respect to the damper mechanisms.

When the player depresses the key 101 without any operation on the sostenuto pedal 147, the rear end portion of the key 101 is brought into abutting engagement with the damper lever 119 and causes the damper lever 119 to rotate in the counter-clockwise direction with respect to the damper lever flange 121. With the lifting motion, the damper 129 leaves from the music wire 109, and the music wire 109 produces a sound due to a striking motion of the hammer 107 driven by the key action mechanism 105. However, if the key 101 is released, the damper mechanism 111 is allowed to pull down the damper 129 toward the music wire 109, so that any free vibration is restricted and, for this reason, forcibly attenuated by the damper 129.

If, on the other hand, the sostenuto pedal 147 is depressed by the player's foot in the depression of the key 101, the sostenuto rod 145 is driven for rotation in the clockwise direction, and the blade member 143 causes the tab lip 139 to rotate in the counter-clockwise direction. However, the tab flange felt 137 restricts the rotation, so that the damper block 123 and, accordingly, the damper rod 127 are lifted up so as to allow the damper 129 to leave from the music wire 109. The blade member 143 keeps the position in so far as the sostenuto pedal 147 is depressed, and, for this reason, the damper 129 does not return to the engaging position with the music wire 109 even though the key 101 is released. This results in that the music wire continues to vibrate, thereby prolonging the sound produced in the music wire 109.

The soft pedal 153 is linked with the shift mechanism 117 for causing fewer than the normal number of strings to be struck, and, for this reason, the soft pedal 153 is used for decreasing the volume or loudness of the sound. The loud pedal 155 is coupled to a lifting rail 157 which is located below the damper levers 119. When the loud pedal 155 is depressed by the right foot of the player, the lifting rail 157 is upwardly lifted, and, accordingly, all of the damper levers 119 concurrently rotate around the damper flanges 121 in the counter-clockwise direction. The damper levers 119 thus concurrently lifted allow all of the dampers 129 to leave the associated music wires, respectively, and, for this reason, any sound produced after the lifting motion of the dampers 129 is prolonged without any restriction of the free vibration.

The mechanical piano illustrated in FIG. 2 further comprises an auxiliary sostenuto pedal mechanism 118, and each of the auxiliary pedal mechanism 118 is provided in association with each of the keys forming part of the keyboard. In this instance, the auxiliary sostenuto pedal mechanism 118 is shared by the dampers 129 associated with the first to twenty-seventh keys from the lowest pitch key, however, the auxiliary sostenuto pedal mechanism 118 may be provided for all of the keys of the keyboard in another implementation.

Figure 3:
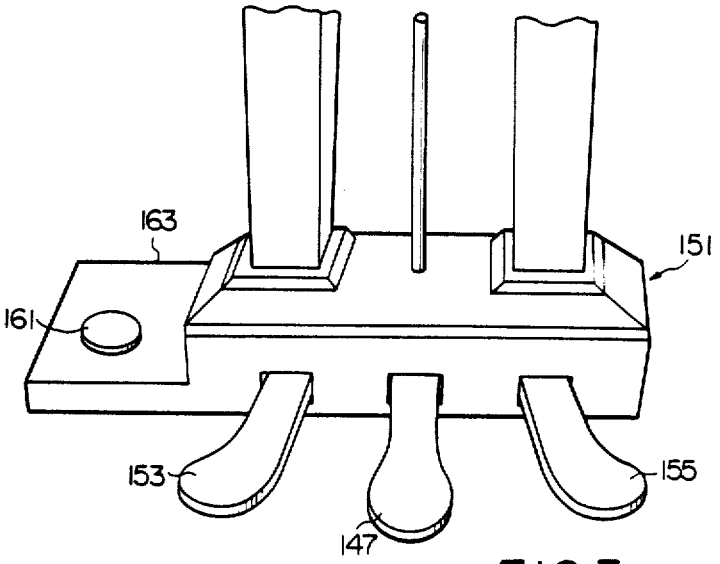
FIG. 3 is a perspective view showing a lyre box forming part of the mechanical piano illustrated in FIG. 2.

The auxiliary sostenuto pedal mechanism 118 largely comprises a push pedal 161 and holding mechanism for achieving a temporal holding operation. As will be better seen from FIG. 3 of the drawings, the lyre box 151 has an extension 163 projecting from the left side wall of the lyre box 151, and the extension 163 is smaller in height than the other portion. The push pedal 161 is provided on the extension 163 and projected from the upper surface of the extension 163. The leading end of the push pedal 161 is located around the soft pedal 153, and the leading end may be roughly equal in height to the soft pedal 153. Thus, the push pedal 161 is provided on the lower extension 163, so that the player easily depresses the push pedal by slightly turning the toe of his left foot with respect to the heel depressing the soft pedal 153.

Figure 4:
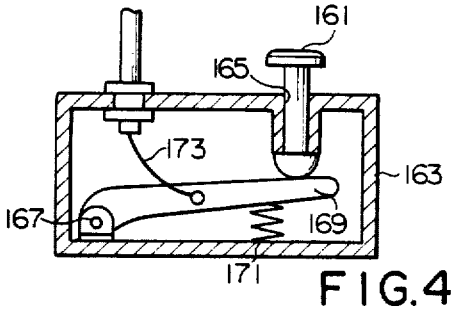
FIG. 4 is a cross sectional view taken along the line X and showing the inside of the lyre box shown in FIG. 3 in the direction indicated by arrows 4.

Turning to FIG. 4 of the drawings, a through hole 165 is formed in the extension 163 and open to the upper surface. In the extension 163 is fixed a supporting block 165 which in turn supports boss portion of a rockable arm member 167. The push pedal 161 passes through the hole 165 and in contact with a leading end portion of the rockable arm member 169. Between the leading end portion and the boss portion is provided a spring member which forcibly rotates the rockable arm member 169 in the counter-clockwise direction. With the resilient force, the rockable arm member 169 is lifted upwardly, so that the push pedal 161 projects from the extension 163 in so far as the player does not depress the push pedal 161. The rockable arm member 169 is further connected at an intermediate portion thereof to a wire 173 which transfers a pulling motion to a swingable arm member 175.

Turning back to FIG. 2, the swingable arm member 175 is coupled at the lower end portion thereof to the wire 173, and the intermediate portion of the swingable arm member 175 is supported by a bracket member 177 which in turn is supported by a frame (not shown) for termination of the music wires. Since a spring member 179 is provided between the bracket member 177 and a slightly upper portion with respect to the center axis of the swingable arm member 175, a resilient force is exerted to the swingable arm member 175 to rotate in the counter-clockwise direction This position is hereinbelow referred to as "retractive position".

Figure 5:
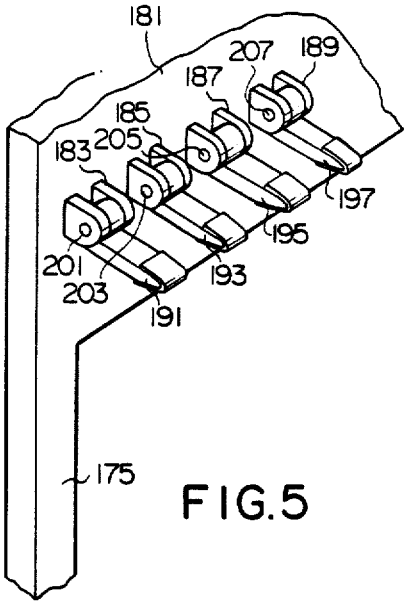
FIG. 5 is a perspective view showing pawl members of an auxiliary sostenuto pedal mechanism forming part of the mechanical piano shown in FIG. 2.

Turning to FIG. 5, the swingable arm member 175 supports a board member, 181 which laterally extends to confront all of the dampers 129 related to the temporal holding operation. On the board member 181 are fixed a plurality of brackets including 183, 185, 187 and 189 which are equal in number to the dampers 129 related to the temporal holding operation. All of the brackets respectively support pawl members, and the pawl members are rotatable around pin members, respectively. The pin members are respectively supported by the brackets, so that the pawl members are angularly movable with respect to the pin members, respectively. The pawl members and the associated pin members related to the brackets 183 to 189 are denoted by reference numerals 191 to 197 and 201 to 207, respectively. For quiet holding operation, felt members are attached to the leading end portions of the pawl members, respectively.

Figure 6:
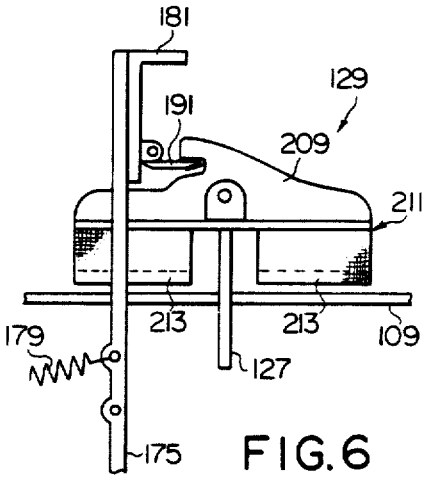
FIG. 6 is a side view showing, an enlarged scale, a pawl member forming part of the auxiliary sostenuto pedal mechanism shown in FIG. 2 and moved into a projectional position.

Turning back to FIG. 2 of the drawings, each of the dampers is formed with a damper wood 209, a damper felt 211 and two guide rail bushings 213, and a pocket 215 is formed in the damper wood 209. When the swingable arm member 175 remains in the retractive position, the pawl member such as 191 is out of the pocket 215. However, if the swingable arm member 175 is driven for rotation in the clockwise direction, the pawl member 191 is inserted into the pocket 215 as shown in FIG. 6, which is hereinbelow referred to as "projectional position".

Figure 7:
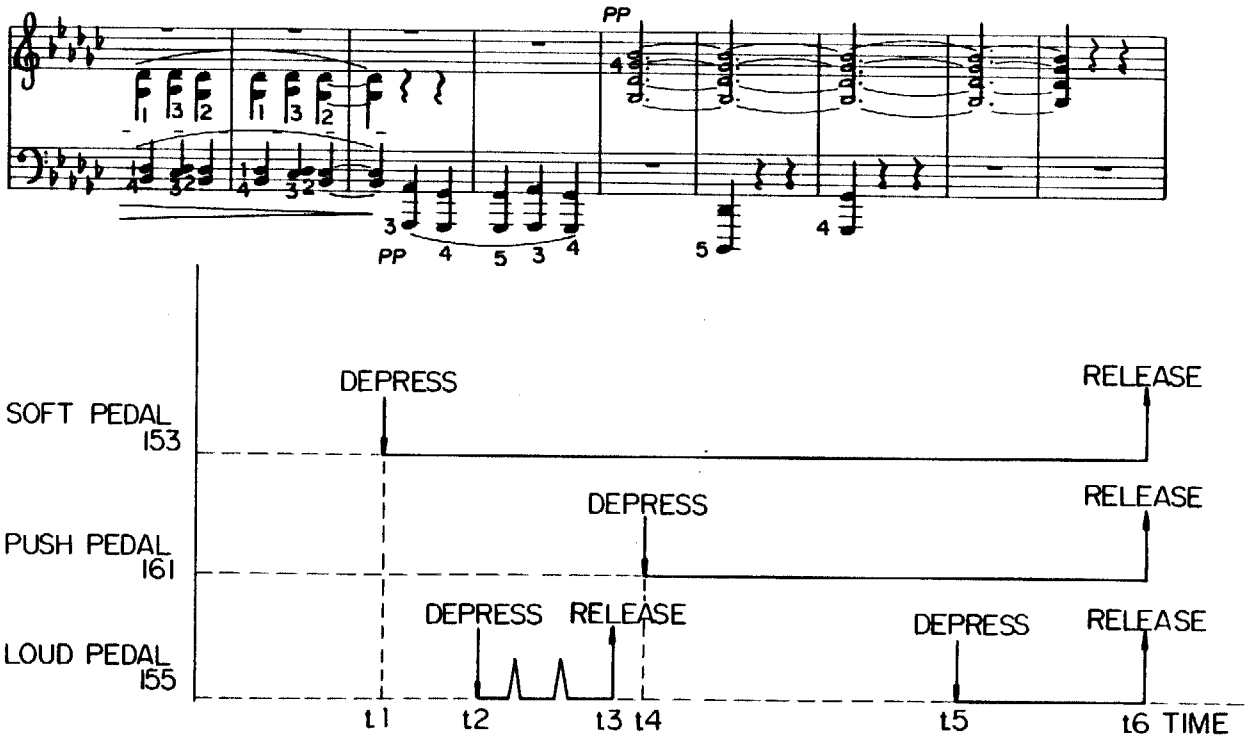
FIG. 7 is a timing chart showing a part of a score and depressions of the pedals for the performance of the music represented by the score.

Description is made for the temporal holding operation with reference to FIG. 7 which shows a final part of the second movement of Chopin's piano sonata B flat minor o.p. 35. When reaching times t1, the player depresses the soft pedal 153 by using the left foot, and, thereafter, the soft pedal is released at time t6. The loud pedal 155 is depressed by the right foot of the player at time t2, then repeating the depression and releasing until time t3 for the half-pedal technique, then being depressed again at time t5, then being released at time t6. Thus, the soft pedal 153 and the loud pedal 155 are depressed by both feet, respectively, so that both feet are busy during time t2 to time t3 and time t5 to time t6. However, the player should impart the sostenuto effect to the bass sounds during time t4 to t6. Since his feet depress both soft and loud pedal at least time t5 to time t6, the player must feel the operation on the sostenuto pedal difficult. In this situation, the player can actuate the auxiliary sostenuto pedal mechanism 119. Namely, when reaching time t4, the player depresses the keys in accordance with the score and, then, depresses the sostenuto pedal 147 with his right foot, because his right foot lies idle. When the sostenuto pedal 147 is depressed, the sostenuto rod 145 and, accordingly, the blade member 143 are driven for rotation in the clockwise direction. The blade member 143 is brought into contact with the tab lips 139 and, accordingly, keeps the dampers 129 in the spaced position from the music wires 109. If both feet lie idle, the loud pedal 155 may be alternatively depressed regardless of the key depression. After the depression of the loud pedal 155, the sostenuto rod 145 and, accordingly, the blade member 143 are driven for rotation by depressing the sostenuto pedal 147. Since all of the tab lips 139 are brought into contact with the blade member 143, all of the dampers 129 are maintained in the spaced positions, respectively. When the dampers 129 are spaced apart from the music wires 109, the player turns his left foot around the heel thereof over a certain angle. His toe is moved above the push pedal 161, so that the player can depress the push pedal 161 by using the toe of his left foot. The push pedal 161 forces the rockable arm member 169 to rotate around the bracket member 167 in the clockwise direction, and, for this reason, the wire 173 is pulled down by the rockable arm member 169. With the pulling motion transferred by the wire 173, the swingable arm member 175 moves in the clockwise direction against the spring member 179. In other words, the swingable arm member 175 and, accordingly, the board member 181 are moved from the retractive position to the projectional position. The dampers 129 lifted up in the spaced position allow the pawl members to enter therein. Thus, the projectional position is thus established in the auxiliary sostenuto pedal mechanism 119, and the dampers 129 are clipped in spaced or lifted-up position regardless of the sostenuto pedal 147. As described hereinbefore, the auxiliary sostenuto pedal mechanism is provided for the dampers 129 associated with the key of the bass part, so that the sounds produced in the music wires assigned to the keys of the bass part are prolonged without any forcible restriction of the dampers, however, the dampers associated with the keys of the other parts are brought into contact with the music wires again upon releasing of the sostenuto pedal 147.

At time t6, the player removes his toe from the push pedal 161, and the rockable arm member 169 and, accordingly, the swingable arm member 175 return to the previous positions with the resilient forces produced by the spring members 171 and 179, respectively. Upon recovery to the retractive position, the dampers lose the support and, return to the abutting engagements with the music wires, respectively. As a result, the player stresses the bass sounds and, accordingly, makes the other sounds clear by using the auxiliary sostenuto pedal mechanism 119.

Of course, the auxiliary sostenuto pedal mechanism 119 is usable instead of the main sostenuto pedal mechanism 113. After the depression of any key of the bass part, the player can depress the push pedal 161 instead of the sostenuto pedal 147. When the push pedal 161 is depressed, the swingable member 175 and, accordingly, the board member 181 are moved from the retractive position to the projectional position, so that the pawl member is inserted into the pocket formed in the damper wood associated with the depressed key. Then, the damper 129 is kept in the spaced position, and, for this reason, the sound produced in the music wire is prolonged for a while. However, if the player removes his toe from the push pedal 161, the swingable arm member 175 returns to the retractive position, and, for this reason, the damper is brought into abutting contact with the music wire again.

Second embodiment

Figure 8:
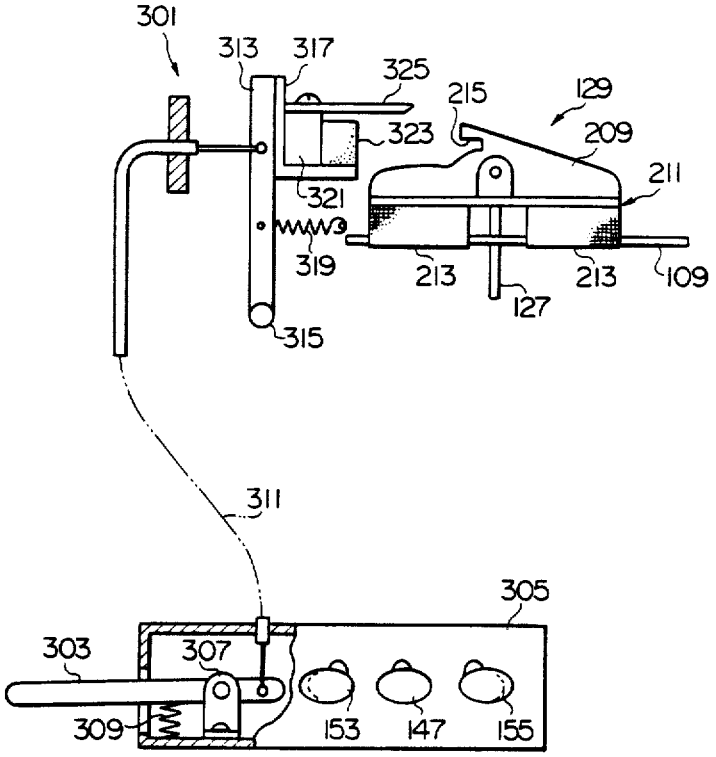
FIG. 8 is a view partially in section and showing another auxiliary sostenuto pedal mechanism embodying the present invention.

Turning to FIG. 8 of the drawings, there is shown an essential part of another mechanical piano embodying the present invention. The mechanical piano shown in FIG. 8 is similar in construction to that shown in FIG. 2 with the exception of an auxiliary sostenuto pedal mechanism 301, and, for this reason, corresponding parts are respectively designated by like reference numerals used in FIG. 2 without any detailed description.

The auxiliary sostenuto pedal mechanism 301 comprises a rockable arm member 303 sidewardly projecting from the left side surface of a lyre box 305, and the rockable arm member 303 is hingedly supported by a bracket member 307. The bracket member 307 is housed in the lyre box 305, and a spring member 309 is provided between the bottom plate of the lyre box 305 and the rockable arm member 303. A wire 311 is connected to the rockable arm member 303 at the opposite side to the projecting side with respect to the bracket member 307, so that the wire 311 is pushed up by the rockable arm member 311 upon depression of the rockable arm member 303. The rockable arm member 303 perpendicularly extends with respect to the soft pedal 153, and, for this reason, the player can easily depress the rockable arm member 303 by turning the toe of his left foot over a certain angle with respect to the heel depressing the soft pedal 153.

The auxiliary sostenuto pedal mechanism 301 further comprises a swingable arm member 313 rotatable around a rotational axis 315, a board member 317 laterally extending so as to face the dampers 129 related to the auxiliary sostenuto function, and a compression spring 319 connected at one end thereof to the swingable arm member 313 and at the other end thereof to a frame (not shown) over which the music wires 109 are stretched. The board member 317 has a generally L-shaped cross section, and a liner block 321 is mounted on the lower edge portion of the board member 313. On the lower edge portion of the board member 313 is further mounted a stopping member 323 which is slightly lower than the liner block 321 and located in front of the liner block 321. On the upper surface of the liner block 321 are fixed a plurality of flexible or resilient strips 325 which are equal in number to the dampers 129. Each of the resilient strips 325 projects over the stopping member 323 and is capable of insertion into the pocket 215 of the confronted damper 129.

While no force is exerted on the rockable arm member 303, the resilient strips 325 remains in the retractive positions by virtue of the spring member 319. However, if the rockable arm 303 is depressed by the player, the wire 311 pushes the swingable arm member 315 against the compression spring 319, and, accordingly, the resilient strips 325 are respectively inserted into the pocket portions 215 of the dampers 129 lifted by the damper mechanisms 111. When the resilient strips 325 are inserted into the pocket portions, respectively, the dampers 129 are clipped in the projectional positions, so that the music wires 109 are allowed to prolong the sounds produced therein. However, when the force is removed from the rockable arm member 303, the compression spring 319 is expanded to allow the swingable arm member 313 to return to the retractive position, so that the dampers 129 are brought into contact with the music wires 109, respectively, thereby forcibly restricting the free vibrations in the music wires 109.

Third embodiment

Figure 9:
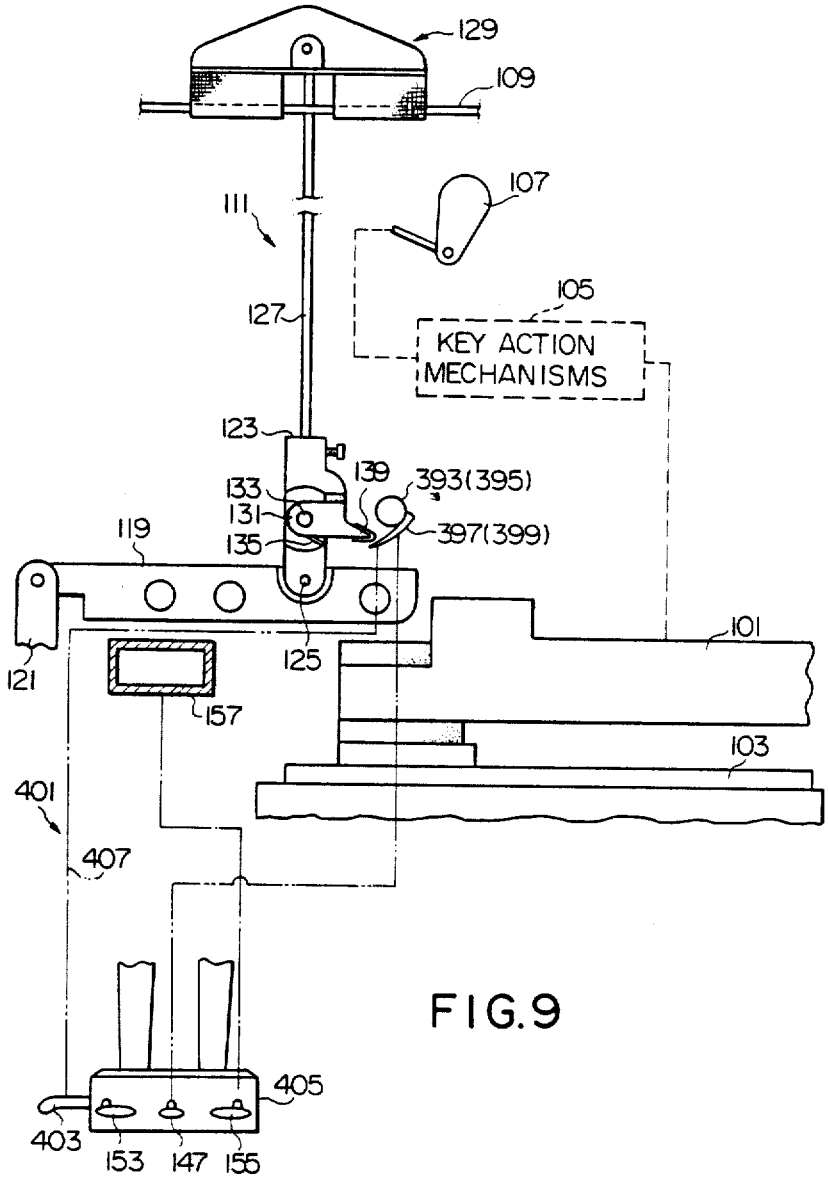
FIG. 9 is a view showing an essential part of still another mechanical piano embodying the present invention.

Turning to FIG. 9 of the drawings, an essential part of still another mechanical piano is illustrated, and an auxiliary sostenuto pedal mechanism 401 is incorporated in the mechanical piano. The other parts are similar to those of the mechanical piano shown in FIG. 2, and, for this reason, like reference numerals are used for designation of the corresponding parts for the sake of the simplicity.

The auxiliary sostenuto pedal mechanism 401 largely comprises a pedal mechanism 403 provided in association with a lyre box 405, and an auxiliary actuation mechanism 407 interconnecting the pedal mechanism 403 and first and second sostenuto rods 393 and 395 with respective blade members 397 and 399. The first sostenuto rods 393 and, accordingly, the blade members 397 are shared by the main sostenuto pedal 147 and the pedal mechanism 403 as described hereinafter, so that the number of the component parts is reduced in comparison with that of the mechanical piano illustrated in FIG. 2.

Figure 10:
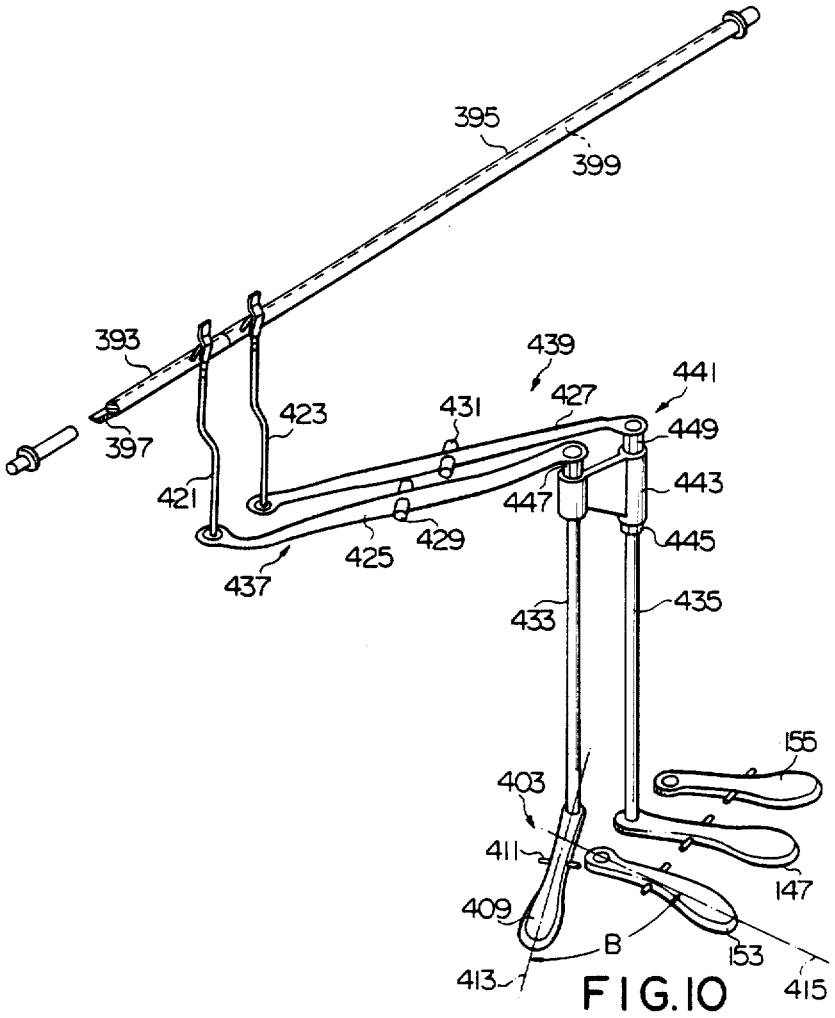
FIG. 10 is a perspective view showing main and auxiliary sostenuto pedal mechanisms incorporated in the mechanical piano shown in FIG. 9.

Description will be made for the structure of the pedal mechanism 403 as well as the auxiliary actuation mechanism 407 with reference to FIG. 10 of the drawings. The pedal mechanism 403 has a rockable pedal 409 projecting from the lyre box 405, and a pin member 411 provides a rotational axis for the rockable pedal 409. The loud, soft and main sostenuto pedals 155, 153 and 147 are arranged substantially parallel to one another, however, the rockable pedal 409 is slightly twisted with respect to these pedals 155, 153 and 147. Namely, assuming that the soft pedal 153 and the rockable pedal 409 have respective virtual lines 413 and 415 extending in the longitudinal directions thereof, the virtual line 413 intersects the virtual line 415 at an acute angle B. By virtue of this arrangement, the player can easily depress the rockable pedal 409 by turning the toe of his left foot the heel of which continues to depress the soft pedal 153.

Figure 11:
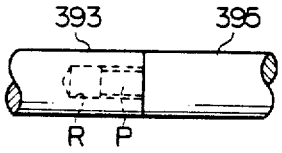
FIG. 11 is a view showing, in an enlarged scale, first and second sostenuto rods incorporated in the mechanical piano shown in FIG. 9.

The first and second sostenuto rods 393 and 395 have respective rotational axes substantially aligned with each other, and first and second vertical rods 421 and 423 are coupled to the outer surfaces of the first and second sostenuto rods 393 and 395, respectively. As will be better seen from FIG. 11, the first sostenuto rod 393 is formed with a recess R, and the second sostenuto rod 395 has a lug portion P. The lug portion P is loosely inserted into the recess R, and, for this reason, the first and second sostenuto rods 393 and 395 are independently rotatable regardless of the other state. To the lower ends of the first and second vertical rods 421 and 423 are respectively jointed first and second horizontal rods 425 and 427 which are rockable around the center rods 429 and 431, respectively. The first and second horizontal rods 425 and 427 are provided beneath a key bed (not shown), and third and fourth vertical rods interconnect the horizontal rods 425 and 427 and the auxiliary and main pedals 409 and 147, respectively. The first and third vertical rods 421 and 433, the first horizontal rod 425 and the center rod 429 as a whole constitute a first link mechanism 437, and the second and fourth vertical rods 423 and 435, the second horizontal rod 427 and the center rod 431 form in combination a second link mechanism 439. The third rod 433 provides a third link mechanism.

Figure 12:
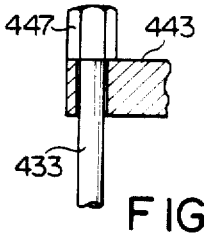
FIG. 12 is a partially sectional view showing a third rod and a part of a coupling member incorporated in the mechanical piano shown in FIG. 9.

A one-way clutch mechanism 441 is implemented by a coupling member 443, a stopping member 445, and two nuts 447 and 449 screwed into the third and fourth rods 433 and 435, respectively. As will be better seen from FIG. 12, the coupling member 443 has two boss portions where two through holes are formed. The third and fourth rods 433 and 435 are loosely inserted into the through holes, respectively, however, the coupling member 443 terminates the travel in the upward direction due to the nuts 447 and 449. The coupling member 443 is sandwiched between the nut 449 and the stopping member, 445, so that the coupling member 443 can not move in both upward and down ward directions with respect to the fourth rod 435. However, no stopping member is provided for the third rod 433, and, for this reason, the coupling member 433 is free from the movement in the downward direction with respect to the third rod 433. The one-way clutch mechanism 441 thus arranged allows the third rod 433 to independently move in the upward direction, however, transmits the upward movement of the fourth rod 435 to the third rod 433.

Figure 13:
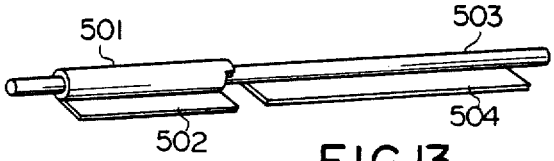
FIG. 13 is a view showing a first modification of the first and second sostenuto rods incorporated in the mechanical piano shown in FIG. 9.

Turning to FIG. 13 of the drawings, there is shown a first modification of the first and second sostenuto rods. The first sostenuto rod 501 is formed by a pipe member and has a first blade member 502. On the other hand, the second sostenuto rod 503 is loosely inserted into the through hole of the pipe member and also supports a second blade 504. The first and second sostenuto rods thus arranged are independently rotatable with each other.

Figure 14:
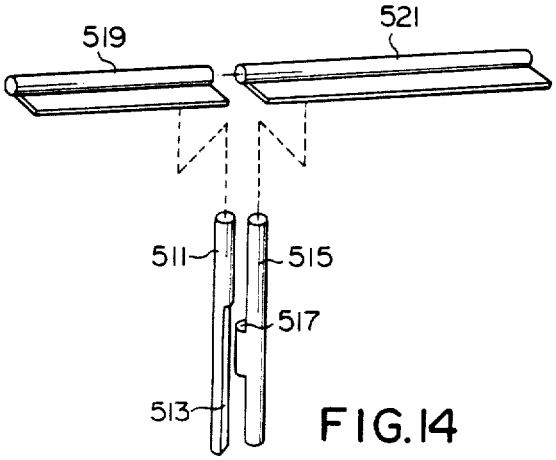
FIG. 14 is a view showing a first modification of the one-way clutch mechanism incorporated in the mechanical piano shown in FIG. 9.

The one-way clutch mechanism may be achieved by shaping the third and fourth vertical rods as shown in FIG. 14. Namely, a third vertical rod 511 is partially cut away to form a longitudinal depression 513, and a forth vertical rod 515 is formed with a land portion 517. The third and fourth vertical rods 511 and 515 are combined with each other in such a manner that the land portion 517 is engageable with the edge of the third vertical rod 511 partially defining the longitudinal depression 513. The third vertical rod 511 is linked with a first sostenuto rod 519, and the fourth vertical rod is linked with a second sostenuto rod 521. If the fourth vertical rod 515 is upwardly lifted to actuate the second sostenuto rod 521, the land portion 517 is brought into contact with the edge of the third vertical rod 511, so that the third vertical rod 511 is concurrently lifted up to actuate the first sostenuto rod 519. If, on the other hand, the third vertical rod 511 is moved in the upward direction, the edge leaves from the land portion 517, so that no movement takes place in the fourth vertical rod 515. This results in that only the first sostenuto rod 519 is actuated independently to the second sostenuto rod 521.

Fourth embodiment

Figure 15:
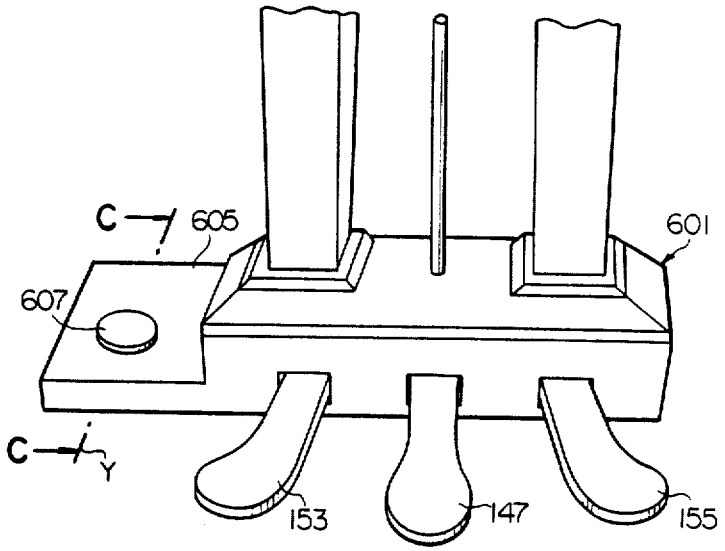
FIG. 15 is a perspective view showing a lyre box incorporated in still another mechanical piano.

Turning to FIG. 15 of the drawings, there is shown a lyre box 601 incorporated in still another mechanical piano embodying the present invention. The auxiliary sostenuto pedal mechanism of the mechanical piano is similar in construction to that shown in FIG. 9 with the exception of a pedal mechanism 603, and, for this reason, corresponding parts are respectively designated by like reference numerals used in FIG. 9 without any detailed description.

The lyre box 601 has an extension 605 projecting from the left side wall of the lyre box 601, and the extension 605 is smaller in height than the other portion. The push pedal 607 is provided on the extension 605 and projected from the upper surface of the extension 605. The leading end of the push pedal 607 is located around the soft pedal 153, and the leading end may be roughly equal in height to the soft pedal 153. Thus, the push pedal 607 is provided on the lower extension 605, so that the player easily depresses the push pedal 607 by slightly turning the toe of his left foot with respect to the heel depressing the soft pedal 153.

Figure 16:
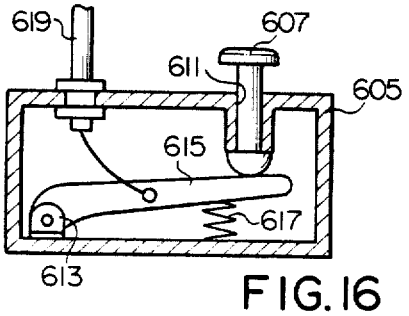
FIG. 16 is a cross sectional view taken along line Y of FIG. 15 and showing the inside of the lyre box in the direction indicated by arrows C.

Turning to FIG. 16 of the drawings, a through hole 611 is formed in the extension 605 and open to the upper surface. In the extension 605 is fixed a supporting block 613 which in turn supports boss portion of a rockable arm member 615. The push pedal 607 passes through the hole 611 and in contact with a leading end portion of the rockable arm member 615. Between the leading end portion and the boss portion is provided a spring member 617 which forcibly rotates the rockable arm member 615 in the counter-clockwise direction. With the resilient force, the rockable arm member 615 is lifted upwardly, so that the push pedal 607 projects from the extension 605 in so far as the player does not depress the push pedal 607. The rockable arm member 615 is further connected at an intermediate portion thereof to a wire 619 which transfers a pulling motion to the third vertical rod.

Fifth embodiment

Figure 17:
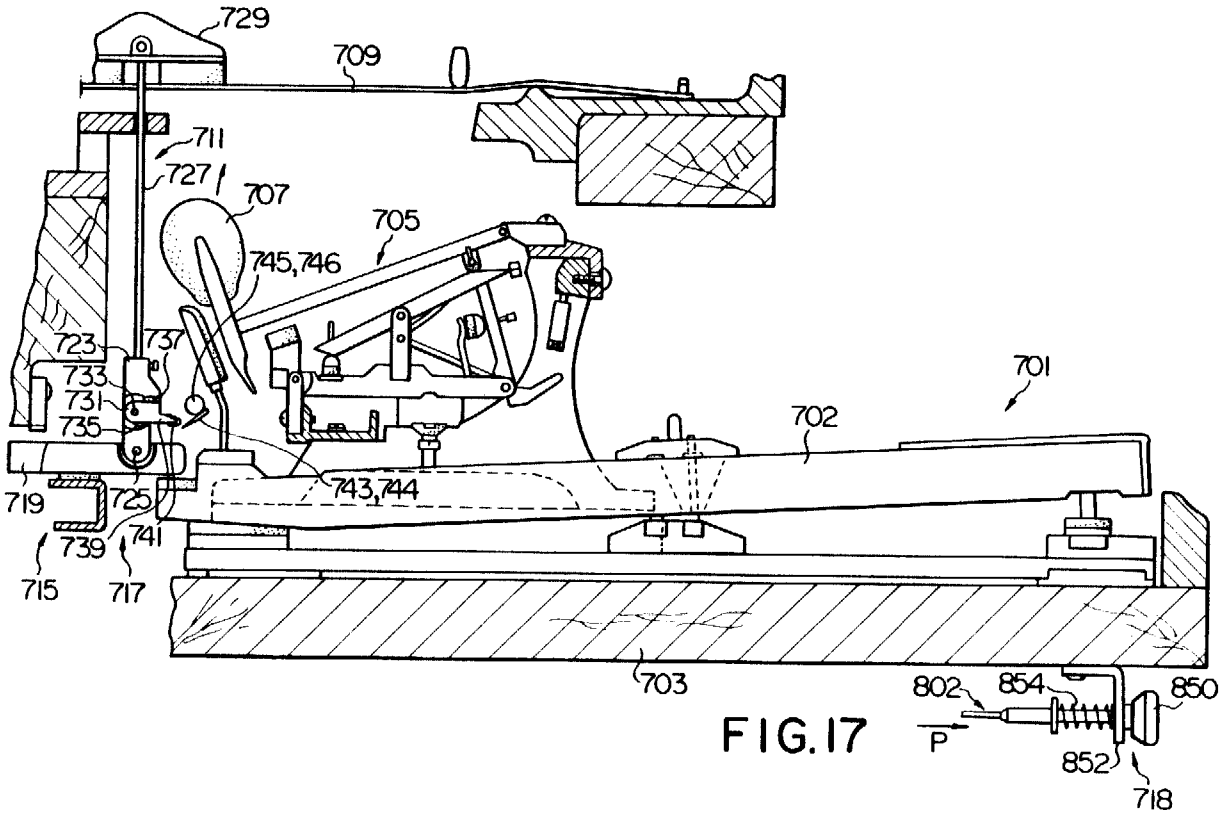
FIG. 17 is a side view showing the arrangement of still another mechanical piano embodying the present invention.
Figure 18:
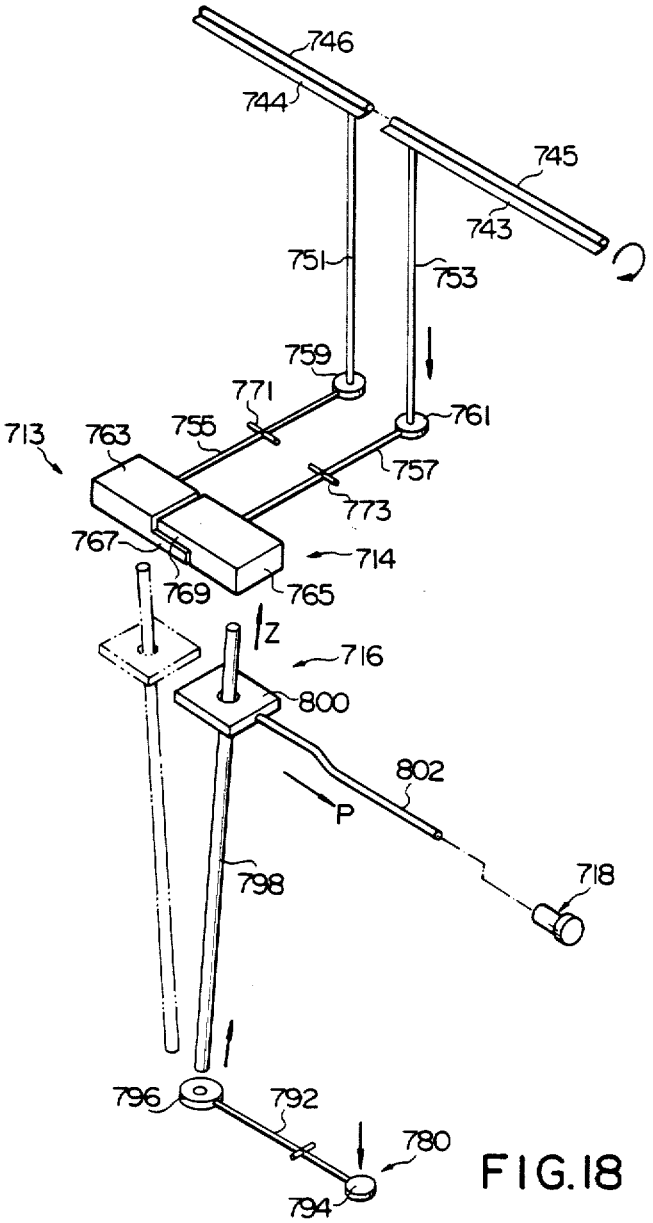
FIG. 18 is a perspective view showing main and auxiliary sostenuto mechanisms incorporated in the mechanical piano shown in FIG. 17.

Turning to FIG. 17 of the drawings, still another mechanical piano largely comprises a keyboard 701 provided with a plurality of, typically 88 keys, (one of which is designated by reference numeral 702), provided on a key bed 703, a plurality of key action mechanisms 705 respectively coupled to the keys for transferring respective key motions to associated hammers 707, a plurality of music wires 709 struck by the associated hammers 707, a plurality of damper mechanisms 711 engageable with the associated keys, respectively, main and auxiliary sostenuto pedal mechanisms 713 and 714 (see FIG. 18), a loud pedal mechanism 715 also shared by the keys, a steering mechanism 716 (see FIG. 18), a soft pedal mechanism 717, and a change-over switch 718 (see FIG. 18). The key action mechanisms 705 , the hammers 707, the music wires 709 and the damper mechanisms 711 are thus provided in association with the keys, respectively, however, description will be focused upon a single set of the mechanisms associated with the key 702.

The damper mechanism 711 has a damper lever 719 connected at one end thereof to a damper lever (not shown). The other end portion of the damper lever 719 is slightly spaced apart from the rear end portion of the key 702 under the releasement of the key 702, however, brought into engagement therewith upon a depression of the key 702. The damper mechanism 711 further has a damper block 723 angularly rotatable around a pin member 725, and a damper wire 727 interconnecting the damper block 723 and a damper 729. The damper 729 is usually in contact with the music wire 709 for restriction on a free vibration produced in the music wire 709, however, momentarily leaves from the music wire 709 upon the depression of the key 702.

The damper block 723 is provided with a tab lip 731 turnable around a pin 733 with respect to the damper block 723, and the tab lip 731 is forced by a spring 735 in the counter-clockwise direction. With the resilient force, the tab lip 731 usually comes into abutting engagement with a tab flange felt 737. The tab lip 731 has a projection 739 covered with a tab lip cloth 741 and confronts to first and second blade members 743 and 744 attached to first and second sostenuto rods 745 and 746. The first and second sostenuto rods 745 and 746 are independently rotatable around the center axes thereof, respectively. The behaviors of the loud pedal and soft pedal mechanisms 715 and 717 are similar to those of the mechanical piano shown in FIG. 2, and no further description is incorporated hereinbelow for the sake of the simplicity.

Description is hereinbelow made for the main and auxiliary sostenuto mechanisms 713 and 714 with reference to FIG. 18. The first sostenuto rod 745 is aligned with and coupled to the second sostenuto rod 746 in such a manner as to rotate independently from each other. The first and second sostenuto rods 745 and 746 are respectively coupled to vertical links 751 and 753 which in turn are coupled to swingable rods 755 and 757 through flexible joints 759 and 761, respectively. The swingable rods 755 and 757 are respectively coupled to block members 763 and 765 at the opposite ends thereof, and the block members 763 and 765 are partially overlapped with each other. Namely, an upper portion of the right side is cut from the block member 763, and, accordingly, the lower portion 767 of the right side projects from the left side of the block member 763. On the other hand, a lower portion of the left side is removed from the block member 765, and, for this reason, the upper portion 769 of the left side penetrates from the right side of the block member 765. The upper portion 769 are placed on the lower portion 767, so that the block members 763 and 765 are partially overlapped with each other. Two pin members 771 and 773 provides respective fulcrums of swing motions, and the swingable rods 771 and 773 angularly rotates with respect to the pin members 771 and 773 in the clock-wise direction or vice versa. When the swingable rods 771 and 773 are driven for angular rotations, the vertical rods 751 and 753 causes the sostenuto rods 746 and 745 and, accordingly, the blade members 743 and 744 to rotate in either direction.

Figure 19:
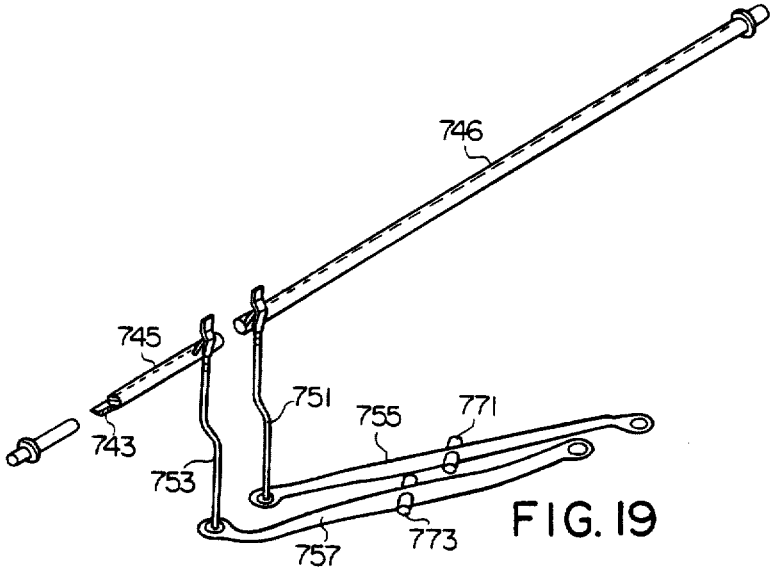
FIG. 19 is a perspective view in a different angle from FIG. 18 showing the main and auxiliary sostenuto mechanisms.

Since the block members 763 and 765 are partially overlapped with each other, if the block member 765 is lifted to the upward direction, only the swingable rod 757 rotates in the clockwise direction. However, when the block member 763 is pushed in the upward direction, not only the block member 763 but also the block member 765 are moved in the upward direction, thereby causing both of the swingable rods 755 and 757 to concurrently rotate in the clockwise direction. In this instance, both sostenuto rods 745 and 746, both blade members 743 and 744, both vertical rods 751 and 753, both swingable rods 755 and 757, both flexible joints 759 and 761, both pin members 771 and 773, and both block members 763 and 765 as a whole constitute the main sostenuto mechanism 713. Moreover, the first sostenuto rod 745, the first blade member 743, the vertical rod 753, the flexible joint 761, the pin member 773, the block member 765 form in combination the auxiliary sostenuto mechanism 714. FIG. 19 shows the main and auxiliary sostenuto mechanisms 713 and 714 in a different angle from FIG. 18. In this instance, the blade member 743 is associated with the damper mechanisms provided for the keys of a lower note range, and the lower note range terminates at the twenty-sixth or twenty-seventh key. On the other hand, the blade member 744 is associated with the damper mechanisms for the keys of middle and higher note ranges, and the higher note range terminates the sixty-nineth key. Then, the main sostenuto mechanism 713 achieves the sostenuto function for the lower, middle and higher note ranges, but the auxiliary sostenuto mechanism 714 is effective to the lower note range only.

Figure 21:
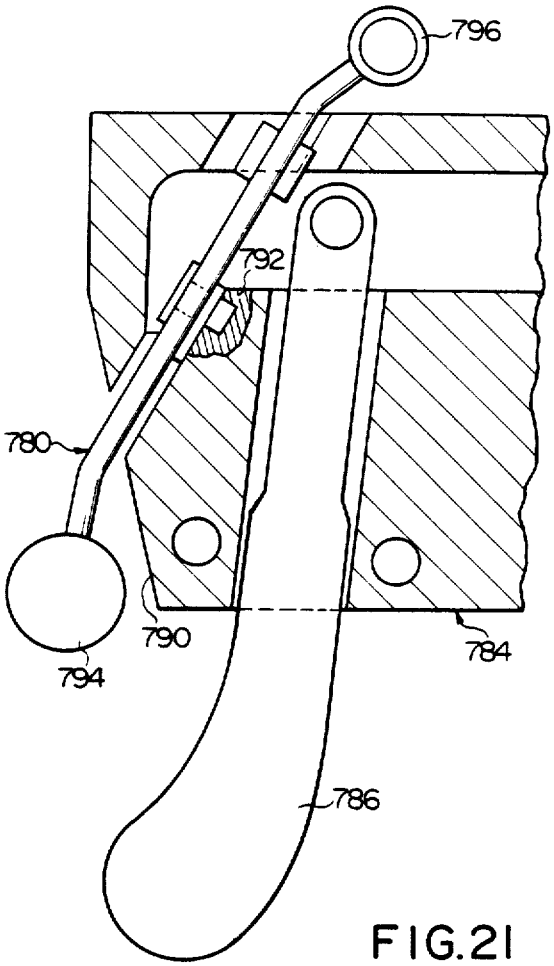
FIG. 21 is a cross sectional view showing the inside of the lyre box shown in FIG. 20.
Figure 22:
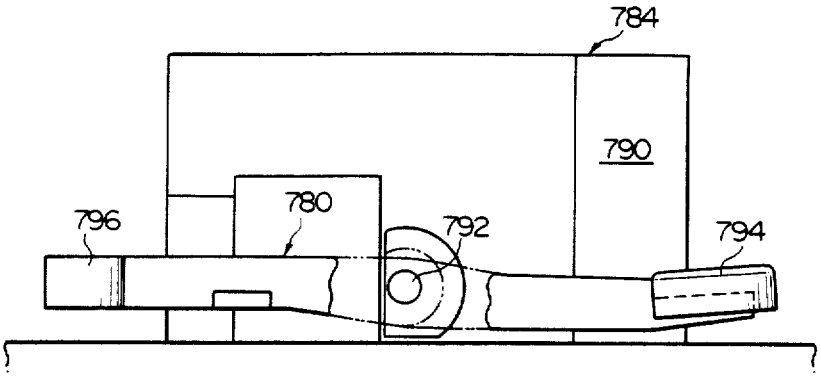
FIG. 22 is a side view showing the lyre box shown in FIG. 20.

Reference numeral 780 designates a sostenuto pedal angularly turnable around a pin member 792 which is supported by a lyre box 784 as shown in FIG. 19. A soft pedal 786 and a loud pedal 788 are also supported by the lyre box 784, and project from the front board of the lyre box 784. The front edge of the left side of the lyre box 784 is partially cut away to form an oblique plane 790, and the sostenuto pedal 782 projects from the oblique plane 790. As will be better seen from FIGS. 21 and 22, the sostenuto pedal 780 has a lug portion 792 which provides a center axis for rotation. The sostenuto pedal 780 is provided in the vicinity of the soft pedal 786, so that the player concurrently can push both of the sostenuto and soft pedal by the left foot. The front end portion 794 of the sostenuto pedal 780 is shaped into a disk configuration, and the rear end portion 796 is formed into a ring configuration.

Figure 24:
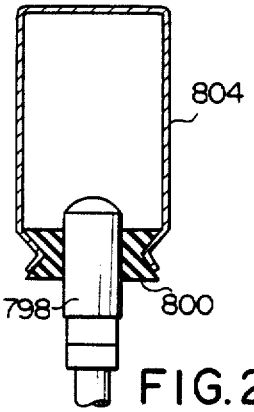
FIG. 24 is a cross sectional view showing a rubber slider supported by a guide member both incorporated in the steering mechanism shown in FIG. 23.
Figure 23:
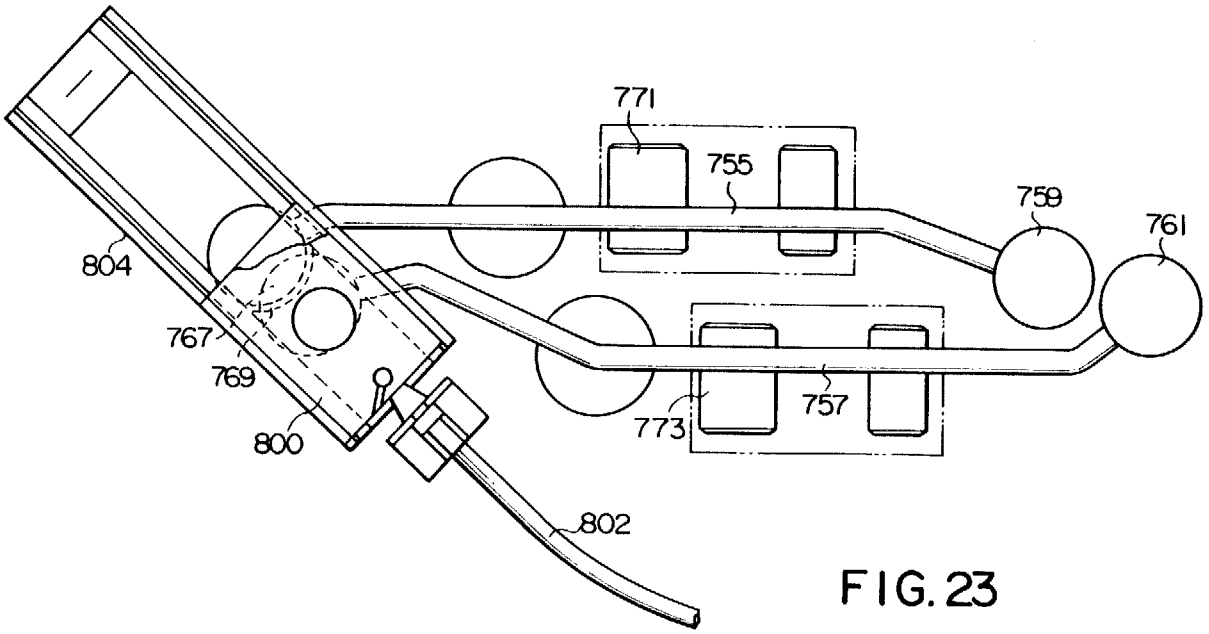
FIG. 23 is a reverse side view showing a steering mechanism incorporated in the mechanical piano showing FIG. 17.

Turning back to FIG. 18, a connection rod 798 is inserted at bottom end portion thereof into the ring-shaped rear end portion 796, and the top end portion of the connection rod 798 pass through an opening formed in a rubber slider member 800. The rubber slider member 800 is connected to the change-over switch 718 through a wire 802, so that the connection rod 798 is shifted between a first position (indicated by dot-and-dash line) and a second position (indicated by a real line) depending upon the position of the change-over switch 718. The rubber slide member 800 is supported by a guide member 804 as shown in FIGS. 23 and 24, and, for this reason, the connection rod 798 is precisely takes the first and second positions. The connection rod 798, the plate member 800, the wire 802 and the rubber guide member 804 as a whole constitute the steering mechanism 716.

Figure 25:
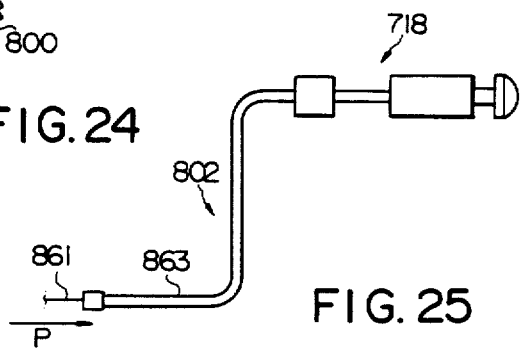
FIG. 25 is a view showing a change-over switch incorporated in the mechanical piano shown in FIG. 17.

Turning back to FIG. 17 of the drawings, The wire 802 is coupled to a pulling member 850 which is supported by an angle plate 852. The angle plate 852 is bolted to the rear surface of the key bed 703, and a spring member 854 is sandwiched between the rear end portion of the pulling member 850 and the angle plate 852. The spring member 854 backwardly pushes the wire 802, and, for this reason, the connection rod 798 is forced to be in the first position. However, if the pulling member 850 is pulled by a player, the wire 802 moves in a direction P, and, accordingly, the connection rod 798 is shifted into the second position. The wire 802 is formed by steel strings 861 inserted into a flexible tube 863, and is curved twice on the way from the pulling member 850 to the rubber slider 800 as shown in FIG. 25.

In a performance, when the player pushes down the sostenuto pedal 780 without pulling the wire 802, the connection rod 798 pushes the block member 763 up, and the block member 763 in turn pushes the block member 765 in the upward direction. The block members 763 and 765 thus pushed up cause the vertical rods 751 and 753 to concurrently move in the downward direction, so that the sostenuto rods 746 and 745 are concurrently driven for rotations, thereby allowing the dampers to continuously leave from the music wires provided in association with the keys in all note ranges.

However, if the player pulls the wire 802, and, then, pushes the sostenuto pedal 780 down, the connecting rod 798 pushes the block member 765 in the upward direction only, because the connection rod 798 was shifted into the second position. The block member 765 merely causes the vertical rod 753 to pull down, and the first sostenuto rod 745 is driven for rotation in the clockwise direction. This results in that the damper mechanisms allows the dampers to leave from the music wires associated with the keys in the lower note range only. As a result, the sostenuto effects are imparted to the sounds produced by depressing the keys in the lower note range.

In this case, when the player leaves from the pulling member 850, the connecting rod 798 returns to the first position, so that the player can impart the sostenuto effect to the sound produced by depressing the keys in all note ranges. In this instance, the player can set a limitation to the note ranges for imparting the sostenuto effect, and, accordingly, emphasizes the sound produced by depressing the keys in the lower note range.

Sixth embodiment

Figure 26:
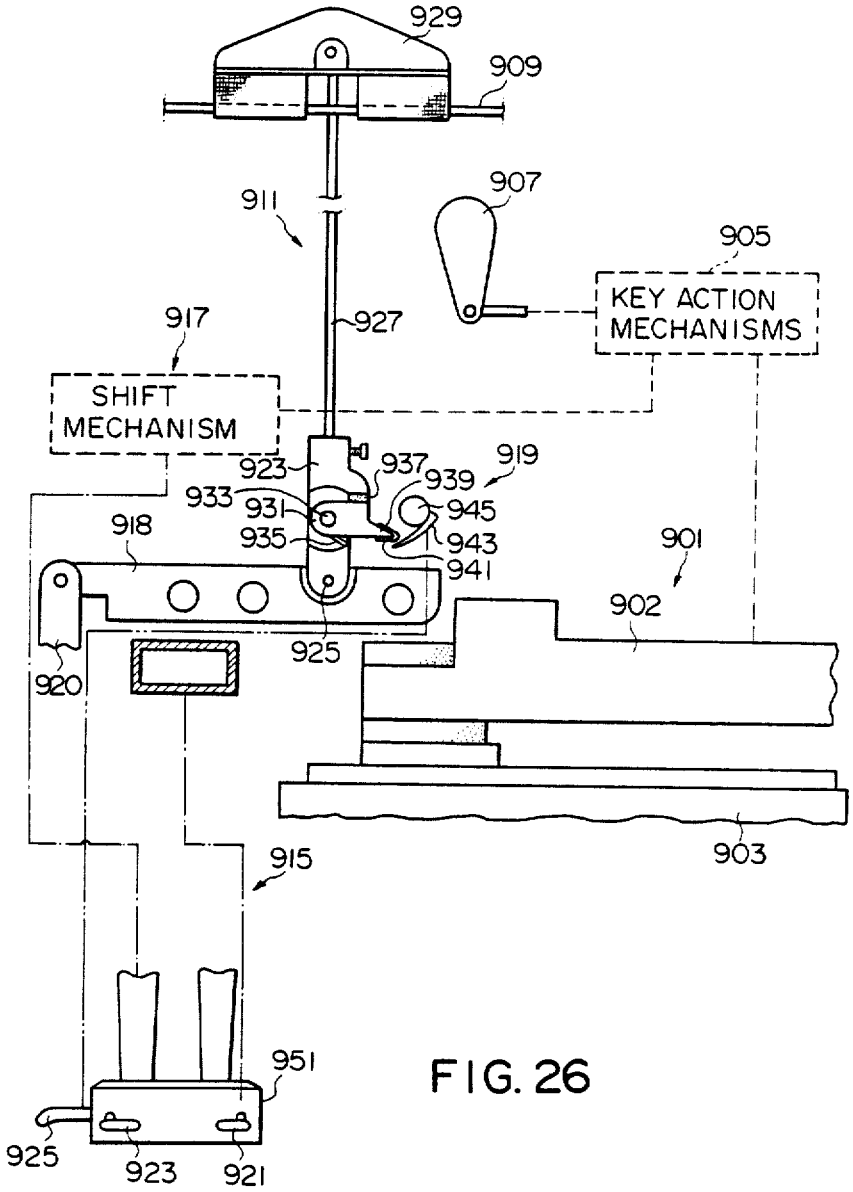
FIG. 26 is a side view showing the arrangement of still another mechanical piano.

Turning to FIG. 26 of the drawings, still another mechanical piano largely comprises a keyboard 901 provided with a plurality of, typically 88 keys, (one of which is designated by reference numeral 902), provided on a key bed 903, a plurality of key action mechanisms 905 respectively coupled to the keys for transferring respective key motions to associated hammers 907, a plurality of music wires 909 struck by the associated hammers 907, a plurality of damper mechanisms 911 engageable with the associated keys, respectively, a loud pedal mechanism 915 also shared by the keys, a soft pedal mechanism 917, and a sostenuto pedal mechanism 919. The loud and soft pedal mechanisms 915 and 917 have a loud pedal 921 and a soft pedal 923, respectively, and the sostenuto pedal mechanism 919 has a sostenuto pedal 925. The key action mechanisms 905, the hammers 907, the music wires 909 and the damper mechanisms 911 are thus provided in association with the keys, respectively, however, only one mechanical line is ilustrated in FIG. 26.

The damper mechanism 911 has a damper lever 918 connected at one end thereof to a damper lever flange 920. The other end portion of the damper lever 918 is slightly spaced apart from the rear end portion of the key 902 under the releasement of the key 902, however, is brought into engagement therewith upon a depression of the key 902. The damper mechanism 911 further has a damper block 923 angularly rotatable around a pin member 925, and a damper wire 927 interconnecting the damper block 923 and a damper 929. The damper 929 is usually in contact with the music wire 909 for restriction on a free vibration produced in the music wire 909, however, momentarily leaves from the music wire 909 upon the depression of the key 902.

The damper block 923 is provided with a tab lip 931 turnable around a pin 933 with respect to the damper block 923, and the tab lip 931 is forced by a spring 935 in the counter-clockwise direction. With the resilient force, the tab lip 931 usually comes into abutting engagement with a tab flange felt 937. The tab lip 931 has a projection 939 covered with a tab lip cloth 941 and confronts to a blade member 943 attached to a sostenuto rods 945.

The behavior of each mechanism is similar to that shown in FIG. 17, so that detailed description is omitted for the sake of simplicity.

Figure 20:
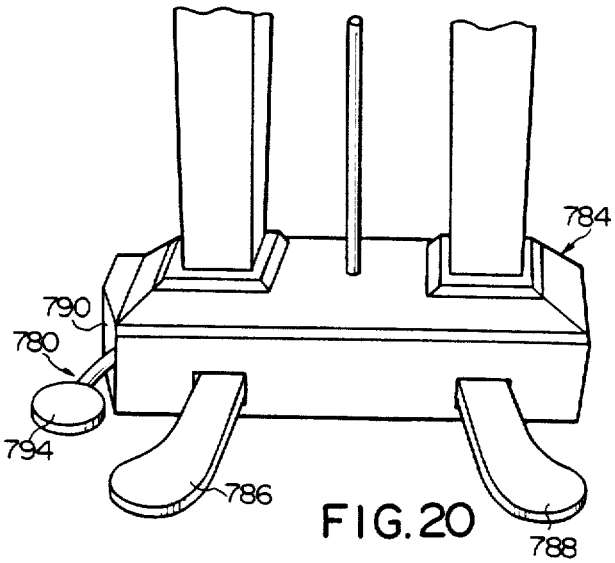
FIG. 20 is a perspective view showing a lyre box of the mechanical piano shown in FIG. 17.

The loud, soft and sostenuto pedals 921, 923 and 925 are supported by a lyre box 951, and are arranged to sandwich the soft pedal 923 between the sostenuto pedal 925 and the loud pedal 921. The lyre box 951 and the arrangement of the pedals 921, 923 and 925 are replaceable with those shown in FIGS. 20, 21 and 22. The pedals 921, 923 and 925 thus arranged are convenient for the player and, accordingly, enhances the operability of the mechanical piano. Namely, the loud pedal is the most frequently used pedal of the three, and the loud pedal is strongly depressed by the foot. The mechanical piano shown in FIG. 26 allows the player to dedicate his right foot to the loud pedal 921, and the left foot is shared by the soft pedal 923 and the sostenuto pedal 925. This decrease the number of movements of the right foot, and, accordingly, the operability is enhanced.

Although particular embodiment of the present invention have been shown and described, it will be obvious to those skilled in the art that various changes and modifications may be made without departing from the spirit and scope of the present invention. The angularly movable pawl members including 191 to 197 are achieved by the combinations of the brackets and the pin members, however, elastic members such as leaf spring members may be available and fixed to the board member 181 in a cantilever fashion.

In the embodiment illustrated in FIG. 18, the first blade member 743 is provided for the lower note range, and the second blade member 744 is associated with the middle and higher note ranges. However, the first and second blade members 743 and 744 may relate to different note ranges, respectively. Moreover, the main sostenuto mechanism 713 is provided in association with the note ranges partially overlapped with the note range covered by the auxiliary sostenuto mechanism 714, however, the main and auxiliary sostenuto mechanisms may be independently provided for the note ranges without any overlapping.

What is claimed is:

1. A mechanical keyboard for producing musical sounds, comprising:

(a) a key board having a plurality of keys grouped by note ranges, said keys being shifted between depressed states and released states, respectively;

(b) a plurality of key action mechanisms respectively coupled to said keys and respectively transferring forces produced by depressing said keys;

(c) a plurality of music wires respectively provided in association with said keys;

(d) a plurality of hammers respectively actuated by said key action mechanisms for striking said music wires;

(e) a plurality of damper mechanisms respectively having dampers and respectively shifted between contact states contacting said music wires and hold off states leaving from said music wires, said dampers being shifted to said contact states in said released states and to said hold off states in said depressed states, respectively, said dampers being associated with said keys, respectively;

(f) a loud pedal mechanism having a loud pedal and operative to cause all of said dampers to shift into said hold off states even if said keys are in said released states;

(g) a soft pedal mechanism having a soft pedal and operative to cause said sounds to be varied in quality or decreased in volume;

(h) a main sostenuto pedal mechanism having a main sostenuto pedal located between said loud pedal and said soft pedal and operative to cause one of or a plurality of said dampers to keep in said hold off states after said associated keys are depressed; and (i) an auxiliary sostenuto pedal mechanism having an auxiliary sostenuto pedal and provided for said dampers associated with said keys of at least one of said note ranges, wherein said auxiliary sostenuto pedal mechanism is operative to allow one or a plurality of said dampers to keep in said hold off states even if said associated keys are released.

2. A mechanical keyboard as set forth in claim 1, in which said mechanical keyboard further comprises a lyre box located under said keyboard and having a front board where said loud, soft and main sostenuto pedals forwardly project and in which said lyre box further has an top board where said auxiliary sostenuto pedal upwardly projects.

3. A mechanical keyboard as set forth in claim 2, in which said auxiliary sostenuto pedal is of a push pedal and has a leading end located around said soft pedal.

4. A mechanical keyboard as set forth in claim 3, in which said auxiliary sostenuto pedal mechanism further comprises a swingable arm member operatively coupled to said auxiliary sostenuto pedal for shifting between a retractive position and a projectional position, a board member supported by the swingable arm member in such a manner as to confront to said dampers associated with said keys of aforesaid one of said note ranges, and a plurality of pawl members supported by the board member and in which said pawl members are respectively inserted into pockets formed in said dampers in said hold off states if said swingable arm member is shifted to said projectional position.

5. A mechanical keyboard as set forth in claim 1, in which said loud, soft and main sostenuto pedals extend in parallel to one another and in which said auxiliary sostenuto pedal extends in such a manner that a virtual extension line of said auxiliary sostenuto pedal intersects virtual extension lines of said loud, soft and main sostenuto pedals at an angle not greater than 90 degrees.

6. A mechanical keyboard as set forth in claim 5, in which said auxiliary sostenuto pedal mechanism further comprises a swingable arm member operatively coupled to said auxiliary sostenuto pedal for shifting between a retractive position and a projectional position, a board member supported by the swingable arm member in such a manner as to confront to said dampers associated with said keys of aforesaid one of said note ranges, a plurality of flexible strips supported by the board member and a stopping member supported by the board member and operative to restrict deformations of the flexible strips, and in which said flexible strips are respectively inserted into pockets formed in said dampers in said hold off states if said swingable arm member is shifted to said projectional position.

7. A mechanical keyboard as set forth in claim 5, in which said virtual extension lines intersect one another at an acute angle.

8. A mechanical keyboard as set forth in claim 7, in which said main sostenuto pedal mechanism has a first sostenuto rod with a first blade member engageable with a plurality of said damper mechanisms associated with said keys of aforesaid one of said note ranges for causing said dampers thereof to shift into said hold off states, a second sostenuto rod with a second blade member engageable with the other dampers for causing said dampers thereof to shift into said hold states, a first link mechanism coupled at one end thereof to the first sostenuto rod, a second link mechanism coupled between the main sostenuto pedal and said second sostenuto rod, a one-way clutch mechanism coupled at one end thereof to the other end of the first link mechanism and at the other end thereof to the second link mechanism and operative to transfer a motion of said second link mechanism to said first second link mechanism for simultaneously actuate the first and second sostenuto rods, and in which said auxiliary sostenuto pedal mechanism has a third link mechanism coupled between said auxiliary sostenuto pedal and said first link mechanism for actuation of said first sostenuto rod.

9. A mechanical keyboard as set forth in claim 3, in which said main sostenuto pedal mechanism has a first sostenuto rod with a first blade member engageable with a plurality of said damper mechanisms associated with said keys of aforesaid one of said note ranges for causing said dampers thereof to shift into said hold off states, a second sostenuto rod with a second blade member engageable with the other dampers for causing said dampers thereof to shift into said hold states, a first link mechanism coupled at one end thereof to the first sostenuto rod, a second link mechanism coupled between the main sostenuto pedal and said second sostenuto rod, a one-way clutch mechanism coupled at one end thereof to the other end of the first link mechanism and at the other end thereof to the second link mechanism and operative to transfer a motion of said second link mechanism to said first second link mechanism for simultaneously actuate the first and second sostenuto rods, and in which said auxiliary sostenuto pedal mechanism has a third link mechanism coupled between said push pedal and said first link mechanism for actuation of said first sostenuto rod.

10. A mechanical keyboard for producing musical sounds, comprising:

(a) a key board having a plurality of keys grouped by note ranges, said keys being shifted between depressed states and released states, respectively;

(b) a plurality of key action mechanisms respectively coupled to said keys and respectively transferring forces produced by depressing said keys;

(c) a plurality of music wires respectively provided in association with said keys;

(d) a plurality of hammers respectively actuated by said key action mechanisms for striking said music wires;

(e) a plurality of damper mechanisms respectively having dampers and respectively shifted between contact states contacting said music wires and hold off states leaving from said music wires, said dampers being shifted to said contact states in said released states and to said hold off states in said depressed states, respectively, said dampers being associated with said keys, respectively;

(f) a loud pedal mechanism having a loud pedal and operative to cause all of said dampers to shift into said hold off states even if said keys are in said released states;

(g) a soft pedal mechanism having a soft pedal and operative to cause said sounds to be varied in quality or decreased in volume;

(h) a main sostenuto mechanism provided for said dampers associated with said keys and operative to cause one of or a plurality of said dampers to keep in said hold off states after said associated keys are depressed;

(i) an auxiliary sostenuto mechanism provided for said dampers associated with said keys of one of said note ranges and operative to cause one of or a plurality of said dampers to keep in said hold off states after said associated keys are depressed;

(j) a sostenuto pedal shared by said main and auxiliary sostenuto mechanisms;

(k) a steering mechanism coupled at one end thereof to said sostenuto pedal and at the other end thereof to said main and auxiliary sostenuto mechanisms; and (l) a change-over switch coupled to said steering mechanism and operative to cause the steering mechanism to couple said sostenuto pedal to either main or auxiliary sostenuto mechanism.

11. A mechanical piano as set forth in claim 10, in which said soft pedal is provided between said loud pedal and said sostenuto pedal.

12. A mechanical piano as set forth in claim 11, in which said loud pedal, said soft pedal and said sostenuto pedal are supported by a lyre box located under a key bed.

* * * * *